US006597327B2

(12) United States Patent
Kanamaluru et al.

(10) Patent No.: US 6,597,327 B2
(45) Date of Patent: Jul. 22, 2003

(54) RECONFIGURABLE ADAPTIVE WIDEBAND ANTENNA

(75) Inventors: Sridhar Kanamaluru, West Windsor, NJ (US); Aly E. Fathy, Langhorne, PA (US); Ayre Rosen, Cherry Hill, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/772,094

(22) Filed: Jan. 26, 2001

(65) Prior Publication Data

US 2002/0101391 A1 Aug. 1, 2002

Related U.S. Application Data

(60) Provisional application No. 60/233,185, filed on Sep. 15, 2000.

(51) Int. Cl.[7] ..... H01Q 15/02

(52) U.S. Cl. ..... 343/909; 343/753; 343/754; 343/781 P

(58) Field of Search ..... 343/700 MS, 754, 343/755, 753, 756, 757, 781 P, 781 R, 909

(56) References Cited

U.S. PATENT DOCUMENTS

| | | | | | |
|---|---|---|---|---|---|
| 5,148,182 | A | | 9/1992 | Gautier et al. | 343/754 |
| 5,262,796 | A | | 11/1993 | Cachier | 343/909 |
| 5,543,809 | A | * | 8/1996 | Profera | 343/753 |
| 5,576,721 | A | * | 11/1996 | Hwang et al. | 343/753 |
| 5,864,322 | A | * | 1/1999 | Pollon et al. | 343/909 |
| 6,081,234 | A | | 6/2000 | Huang et al. | 343/700 MS |
| 6,081,235 | A | * | 6/2000 | Romanofsky et al. | 343/700 MS |
| 6,091,371 | A | | 7/2000 | Buer et al. | 343/754 |
| 6,281,852 | B1 | * | 8/2001 | Amarillas | 343/725 |

FOREIGN PATENT DOCUMENTS

| | | | |
|---|---|---|---|
| WO | WO 99/25044 | 5/1999 | H01Q/1/38 |

OTHER PUBLICATIONS

PCT International Search Report, PCT/US 01/28591, Apr. 3, 2002.

Targonski and Pozar, "Analysis and Design of a Microstrip Reflectarray Using Patches of Variable Size", *IEEE Symposium on Antennas and Propagation Digest*, vol. 3, pp. 1820–1823, Jun. 1994.

Targonski et al., "Design of Millimeter Wave Microstrip Reflectarrays", *IEEE Trans. on Antennas and Propagation*, vol. 45, No. 2, pp. 287–296, Feb. 1997.

Huang and Pogorzelski, "A Ka–Band Mictrostrip Reflectarray with Elements Having Variable Rotation Angles", *IEEE Trans. on Antennas and Propagation*, vol. 46, No. 5, pp. 650–656, May 1998.

Pozar et al., "A Shaped–Beam Mictrostrip Patch Reflectarray", *IEEE Trans. on Antennas and Propagation*, vol. 47, No. 7, pp. 1167–1173, Jul. 1999.

Puente–Baliarda et al., "On the Behavior of the Sierpinski Multiband Fractal Antenna", *IEEE Trans. on Antennas and Propagation*, vol. 46, No. 4, Apr. 1998.

* cited by examiner

*Primary Examiner*—Tho Phan
(74) *Attorney, Agent, or Firm*—William J. Burke

(57) ABSTRACT

A reconfigurable adaptive wideband antenna includes a reconfigurable conductive substrate for dynamic reconfigurablility of the frequency, polarization, bandwidth, number of beams and their spatial directions, and the shape of the radiation pattern. The antenna is configured as a reflect array antenna having a single broadband feed. Reflective elements are electronically painted on the reconfigurable conductive surface using plasma injection of carriers in high-resistivity semiconductors.

14 Claims, 2 Drawing Sheets

RECONFIGURABLE ADAPTIVE WIDEBAND ANTENNA

This application claims benefit of U.S. provisional patent application Ser. No. 60/233,185, filed Sep. 15, 2000, which is herein incorporated by reference.

The invention generally relates antenna systems and, more particularly, the invention relates to a reconfigurable adaptive wideband antenna.

BACKGROUND OF THE INVENTION

The detection, location, identification, and characterization of electromagnetic (EM) signals of types that have a low probability of intercept is an increasingly challenging problem. In general, EM signals with a low probability of intercept are transmitted by adversarial sources and thus employ various methods to reduce their signature. Such methods include frequency hopping, multiple signal polarizations, and spread-spectrum encoding techniques. In addition, the locations of the sources of such signals are not fixed and may change quite rapidly. The number of sources or EM signals that need to be located and tracked may also change depending on the particular circumstances.

A broadband antenna is generally required in order to track such EM signals. Frequency independent antennas such as spirals and quasi-frequency independent antennas such as log-periodic antennas are quite large and their use in an antenna array is quite limited. Also, an adaptive array using such broadband elements would require a feed structure integrated to a true-time delay network in order to achieve multiple beams and beam scanning. Such feed networks are difficult to design and are expensive to implement.

Therefore, there exists a need in the art for an adaptive wideband antenna capable of dynamic reconfiguration of operating frequency, polarization, bandwidth, number of beams and their spatial directions, and radiation pattern shape without the need for a feed network.

SUMMARY OF THE INVENTION

The disadvantages associated with the prior art are overcome by a reconfigurable adaptive wideband antenna capable of dynamic reconfigurability of several antenna parameters. Specifically, the present invention is a reflect array antenna comprising a reconfigurable conductive substrate and a single broadband feed. The reconfigurable conductive substrate is capable of dynamically forming conductive surfaces that can be used as reflective elements in the array. The conductive surfaces are electronically painted on the substrate using plasma injection of carriers in high-resistivity semiconductors. The reflective elements can be configured in many formations, including frequency independent fractal formations, that allow for wideband operation of the antenna.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
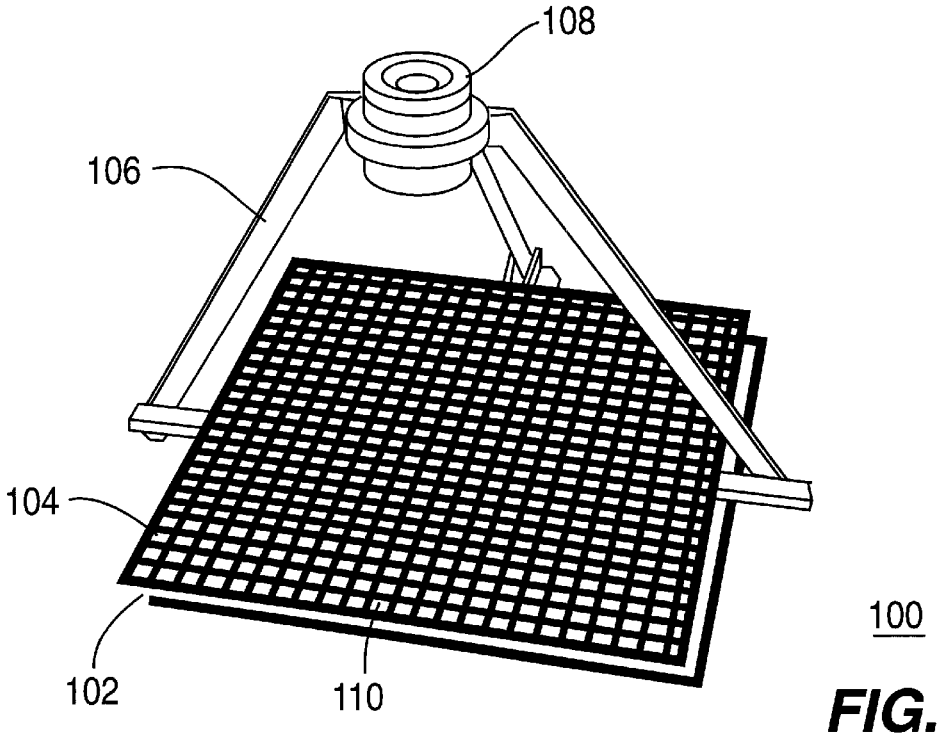
FIG. 1 depicts a perspective view of a reconfigurable adaptive wideband antenna.

FIG. 1 depicts a perspective view of a reconfigurable adaptive wideband antenna 100 embodying the present invention. The antenna 100 comprises a frame 102, a reconfigurable conductive substrate 104, a tripod 106, and a feed horn 108. The reconfigurable conductive substrate 104 is mounted within the frame 102, which is integral with the tripod 106. The tripod 106 supports the feed horn 108, which is positioned at a predetermined location above the antenna 100. The reconfigurable conductive substrate 104 is capable of electronically "painting" conductive surfaces in any shape, size, number, or location. Such conductive surfaces can be used as reflective elements for the antenna 100. In the present embodiment of the invention, the reconfigurable conductive substrate 104 includes a plurality of reflective elements 110 disposed in a planar array formation.

The reconfigurable adaptive wideband antenna 100 operates as a reflect array antenna. The reflective elements 110, therefore, do not require any type of feed network. In response to an excitation, electromagnetic energy radiates from the feed horn 108 to illuminate the plurality of reflecting elements 110. The plurality of reflecting elements 110 reflect the energy radiated from the feed horn 108 as a collimated wave (also known as the main beam) in a particular direction. The main beam can be scanned by coupling phase shifters or true-time delay lines to the plurality of reflective elements 110, as is well understood in the phased array art. With the proper phase design or phase-changing device incorporated into each reflecting element 110, the main beam can be tilted or scanned through large angles (e.g., 50° from the planar aperture broadside direction). Although the antenna 100 has been described in transmission mode, it is understood by those skilled in the art that the present invention is useful for both transmitting and receiving modes of operation.

The extent to which the planar array formation of reflective elements 110 allows the antenna 100 to be adaptive in terms of frequency of operation, bandwidth, and number and location of beams and nulls is very limited. As indicated above, however, the present invention is capable of dynamically reconfiguring conductive patterns on the reconfigurable conductive substrate 104. This capability provides for maximum flexibility and adaptivity in defining the antenna structure. A very broad class of planar antennas can be implemented by electronically painting various conductive surfaces to generate the reflective elements 110, which include dipoles, patches, spirals, and general arbitrary shapes and sizes. In addition, the conductive surfaces can also be used to provide the phase delay structures required in order to scan the main beam in a particular direction.

Figure 2:
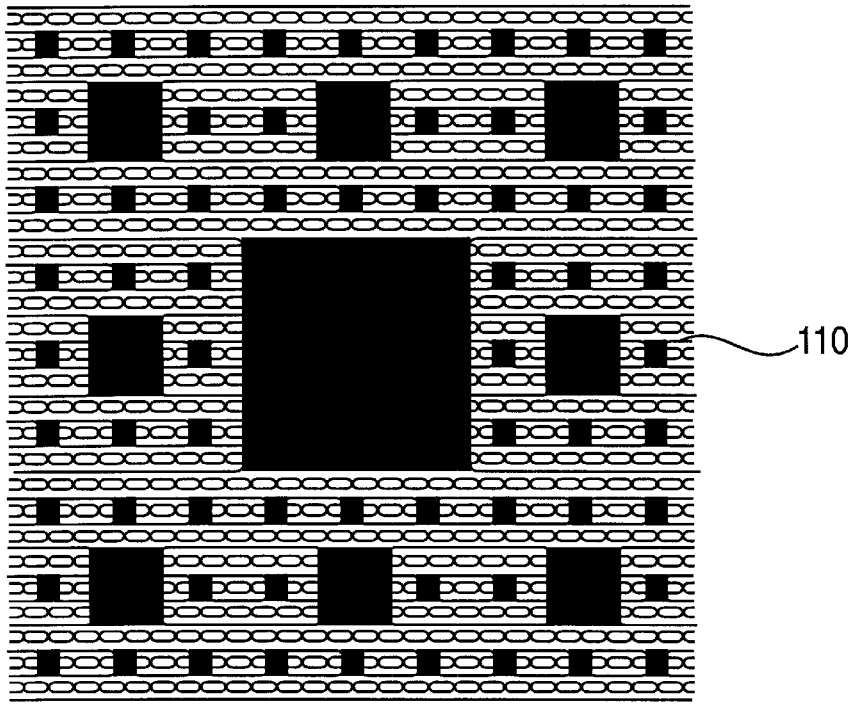
FIG. 2 illustrates a fractal formation of reflective elements.

For example, FIG. 2 shows a fractal formation of reflective elements 110. Fractal formations of antenna elements are known to be frequency independent and are more particularly described in "Fractal Antenna Engineering: The Theory and Design of Fractal Antenna Arrays," D. H. Werner et al., IEEE Antennas and Propagation Magizine, Vol. 41, No. 5, October 1999, at pages 37–59. FIG. 2 shows the fractal formation known as the Sierpinski carpet. An array of reflective elements in such a formation provides the antenna 100 with frequency-independent multiband characteristics and a scheme for realizing low sidelobe performance.

Figure 3:
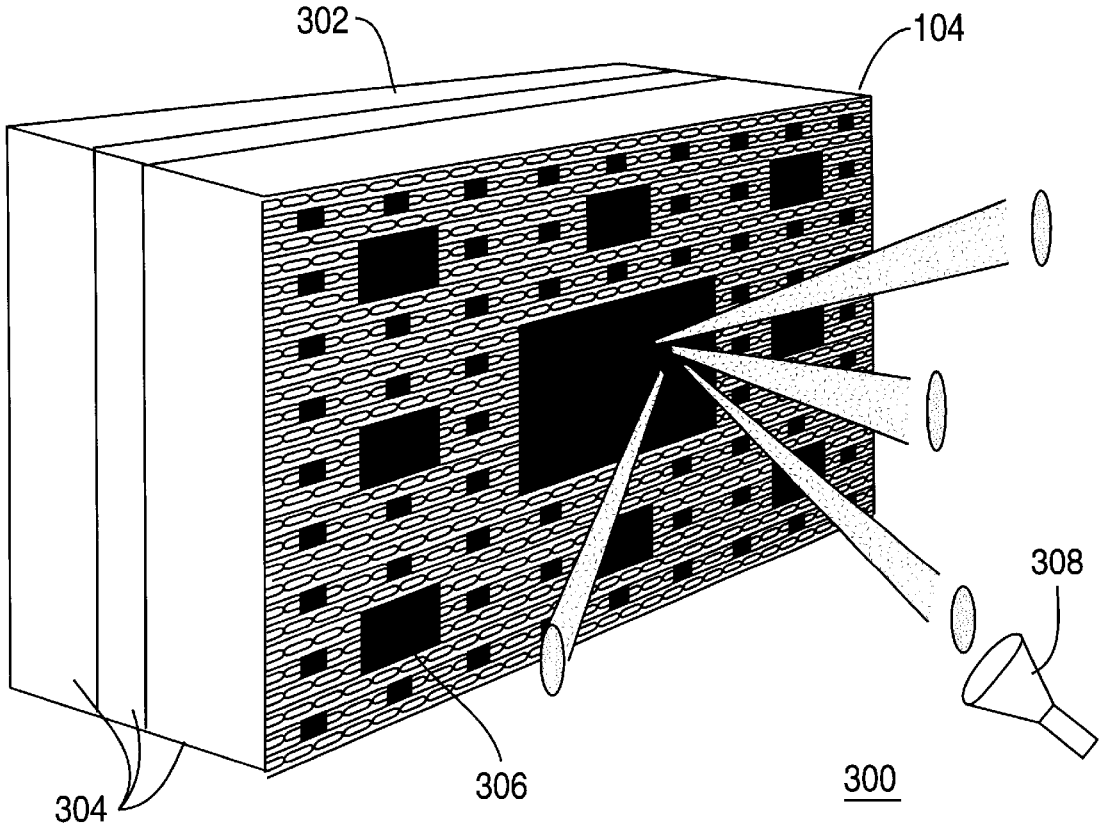
FIG. 3 depicts an alternative embodiment of a reconfigurable adaptive wideband antenna.

FIG. 3 depicts an alternative embodiment of a reconfigurable adaptive wideband antenna 300. The antenna 300 comprises a control layer 302, at least one ground plane 304 (3 are shown), and a reconfigurable conductive substrate 104. In the present embodiment of the invention, the reconfigurable conductive substrate 104 is configured with a Sierpinski carpet formation of reflective elements 306. The reflective elements 306 are excited by a single broadband feed 308, such as, but not limited to, a ridge waveguide feed horn or a spiral antenna. Utilization of the single broadband feed 308 eliminates the need for a complex feed network, increasing the efficiency of the antenna 300.

The fractal formation of reflective elements 306 allows for wideband operation of the antenna 300 by defining sub-arrays of elements at all operating bands. Each ground plane 304 is frequency selective and provides a ground plane for each sub-array of elements at a particular operating frequency. The control layer 302 provides biasing control for the reconfigurable conductive substrate 104 and also includes adaptive processing electronics.

Figure 4:
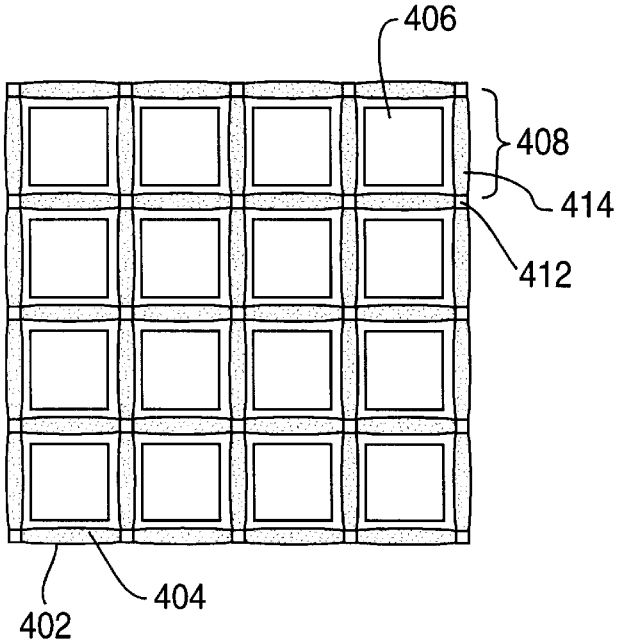
FIG. 4 depicts a detailed view of an exemplary reconfigurable conductive substrate.

FIG. 4 depicts a detailed view of an exemplary reconfigurable conductive substrate 104. The reconfigurable conductive substrate 104 comprises a dielectric sheet 402 having an active semiconductor layer 404 planted on the backside. In the present embodiment, the semiconductor layer 404 is made of thin, high-resistivity silicon. An array of trenches 406 is etched into the semiconductor layer 404 (a 4×4 array is shown), leaving the semiconductor layer 404 in a mesh formation. A plurality of PIN diodes 408 are integrated in the remaining semiconductor layer 404, each PIN diode being adjacent to each side of each trench 406. Each of the PIN diodes 408 comprises a doped $p^+$ region 410, a doped $n^+$ region 412, and an intrinsic region 414.

The reconfigurable conductive substrate 104 is capable of electronically painting conductive surfaces by utilizing junction carrier injection in high-resistivity silicon. It is known that carriers in semiconductors form a plasma, which at high enough levels, causes the semiconductor to behave as a metallic medium. Formation of plasma in semiconductors is more particularly described in "The Effects of Storage Time Variations on the Forward Resistance of Silicon $p^+$-n-$n^+$ Diodes at Microwave Frequencies," R. U. Martinelli, IEEE Trans. Electron Devices, Vol. ED27, No. 9, September 1980.

Returning to FIG. 4, when one of the PIN diodes 408 is correctly biased, carriers are injected into the intrinsic region 414 of the diode 408 so as to form plasma-filled conductive regions. The plasma is confined to the intrinsic region 414 by the respective adjacent trenches 406. By selectively biasing particular PIN diodes 408, a pattern of conductive surfaces can be formed, limited only to the resolution of the mesh formation of the semiconductor layer 404. If the cell dimensions of the mesh formation are smaller than about 1/10 of a wavelength of the RF signal, then the mesh behaves as a solid conductor sheet to the RF signal. Thus, conducting planar regions of any desired shape or size can be formed on the backside of the dielectric sheet 402 utilizing this conductive mesh.

Although various embodiments which incorporate the teachings of the present invention have been shown and described in detail herein, those skilled in the art can readily devise many other varied embodiments that still incorporate these teachings.

What is claimed is:

1. An antenna comprising:

a semiconductor substrate having a plurality of semiconductor devices integrated therein, wherein said semiconductor devices are capable of becoming reflective elements via junction carrier injection; and a feed element for radiating energy to, or absorbing energy from, said reflective elements.

2. The antenna of claim 1 wherein said semiconductor substrate comprises high-resistivity silicon.

3. The antenna of claim 1 wherein said plurality of semiconductor devices are a plurality of PIN diodes.

4. The antenna of claim 1 wherein said plurality of semiconductor devices are integrated in an N×N array within said semiconductor substrate.

5. The antenna of claim 1 wherein said reflective elements are in a planar array formation.

6. The antenna of claim 1 wherein said reflective elements are in a Sierpinski carpet formation.

7. The antenna of claim 1 wherein said feed element is a feed horn.

8. A wideband adaptive antenna system comprising:

a semiconductor substrate having a plurality of semiconductor devices integrated therein, wherein said semiconductor devices are capable of becoming reflective elements via junction carrier injection;

at least one groundplane;

an adaptive control layer for controlling said reflective elements; and a feed element for radiating energy to, or absorbing energy from, said reflective elements.

9. The antenna system of claim 8 wherein said semiconductor substrate comprises high-resistivity silicon.

10. The antenna system of claim 8 wherein said plurality of semiconductor devices are a plurality of PIN diodes.

11. The antenna system of claim 8 wherein said plurality of semiconductor devices are integrated within said semiconductor substrate in an N×N array.

12. The antenna system of claim 8 wherein said reflective elements are in a planar array formation.

13. The antenna system of claim 8 wherein said reflective elements are in a Sierpinski carpet formation.

14. The antenna system of claim 8 wherein said feed element is a feed horn.

* * * * *